US010369723B2

(12) United States Patent
Rieger

(10) Patent No.: US 10,369,723 B2
(45) Date of Patent: Aug. 6, 2019

(54) CARRIAGE FOR A WALL SAW

(71) Applicant: Hilti Aktiengesellschaft, Schaan (LI)

(72) Inventor: Hans-Joerg Rieger, Thueringen (AT)

(73) Assignee: Hilti Aktiengesellschaft, Schaan (LI)

( * ) Notice: Subject to any disclaimer, the term of this patent is extended or adjusted under 35 U.S.C. 154(b) by 122 days.

(21) Appl. No.: 15/559,479

(22) PCT Filed: Mar. 16, 2016

(86) PCT No.: PCT/EP2016/055640

§ 371 (c)(1),
(2) Date: Sep. 19, 2017

(87) PCT Pub. No.: WO2016/150784

PCT Pub. Date: Sep. 29, 2016

(65) Prior Publication Data

US 2018/0104851 A1 Apr. 19, 2018

(30) Foreign Application Priority Data

Mar. 23, 2015 (EP) ..... 15160319

(51) Int. Cl.
*B28D 1/04* (2006.01)

(52) U.S. Cl.
CPC ..... *B28D 1/047* (2013.01); *B28D 1/044* (2013.01); *B28D 1/045* (2013.01)

(58) Field of Classification Search
CPC ..... B28D 1/047; B28D 1/044; B28D 1/045
USPC ..... 125/13.01
See application file for complete search history.

(56) References Cited

U.S. PATENT DOCUMENTS 2,736,311 A 2/1956 Coates
4,938,201 A * 7/1990 Chiuminatta ..... B24B 19/02 125/13.01
5,305,729 A 4/1994 Chiuminatta et al.
5,724,956 A * 3/1998 Ketterhagen ..... B28D 1/045 125/12
6,234,889 B1 * 5/2001 Huboud Peron .... B23D 45/006 125/12
6,349,712 B1 * 2/2002 Halstead ..... B28D 1/045 125/12
6,427,677 B1 * 8/2002 O'Banion ..... B23D 45/02 125/13.01
7,007,686 B1 * 3/2006 Zuzelo ..... B28D 1/045 125/12
7,198,042 B2 * 4/2007 Harris ..... B23Q 9/0042 125/13.01

(Continued)

OTHER PUBLICATIONS

Search Report of PCT/EP2016/055640, dated Jun. 14, 2016, 2 pages.

*Primary Examiner* — George B Nguyen
(74) *Attorney, Agent, or Firm* — Davidson, Davidson & Kappel, LLC

(57) ABSTRACT

A carriage (50) for a wall saw that includes a saw head and a motor-driven feed unit with a guide slide and a feed motor. The carriage is made up of a base frame (51) with a supporting frame (55) and a receiving plate (56), a guide frame (52) with a handle (58), and a chassis (53) with a first axle (64), a second axle (66), and at least three wheels (65, 67). At least one wheel (65) of the chassis (53) is designed to be connectable to a gearwheel (45) of the guide slide (26) in a force- and torque-transmitting manner with the aid of a connection device.

13 Claims, 10 Drawing Sheets

(56) References Cited

U.S. PATENT DOCUMENTS

| | | | | |
|---|---|---|---|---|
| 7,909,410 | B2 * | 3/2011 | Collister | B23D 45/003 299/39.1 |
| 9,808,961 | B2 * | 11/2017 | Jenkins | B28D 1/045 |
| 2002/0168921 | A1 * | 11/2002 | Adachi | B23D 45/027 451/5 |
| 2004/0159315 | A1 * | 8/2004 | Howard | B27B 9/02 125/13.01 |
| 2006/0201492 | A1 * | 9/2006 | Baratta | B23D 47/02 125/21 |
| 2006/0225722 | A1 * | 10/2006 | Markley | B28D 1/045 125/13.01 |
| 2014/0224237 | A1 | 8/2014 | Ronzello, Sr. et al. | |

* cited by examiner

Fig. 1A
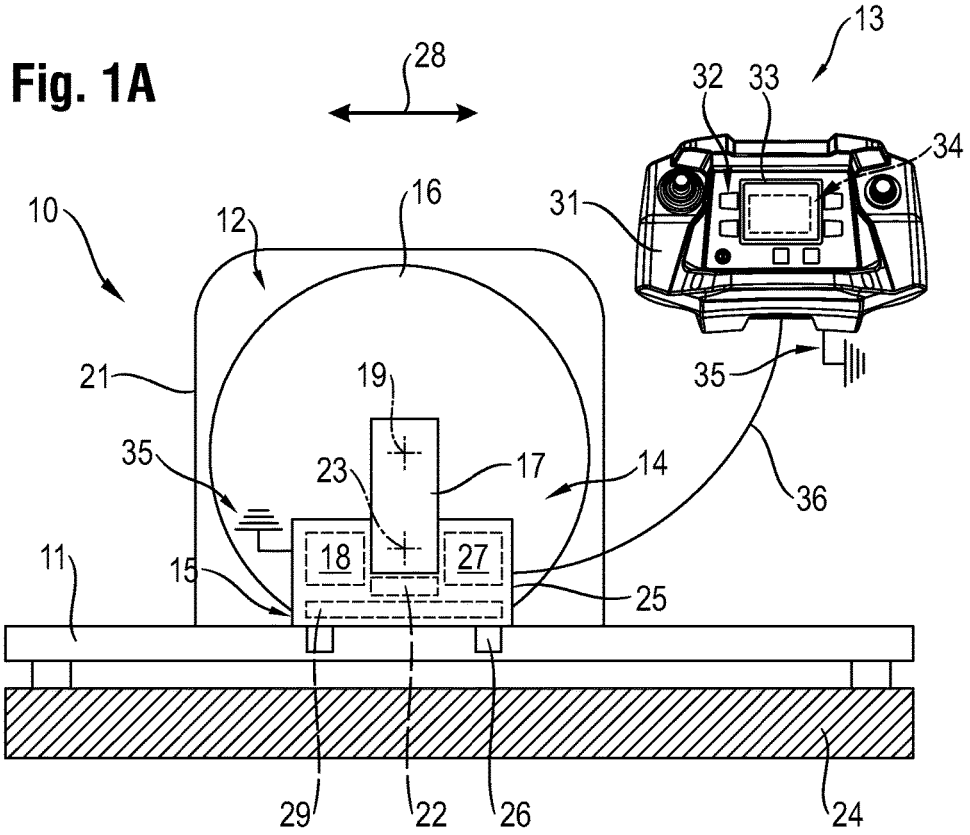
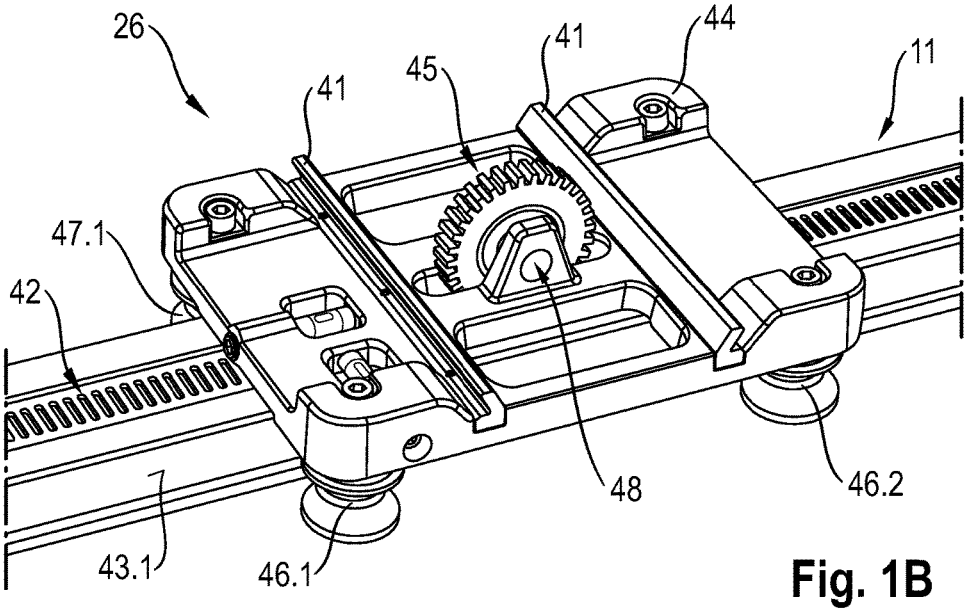
Fig. 1B

CARRIAGE FOR A WALL SAW

TECHNICAL FIELD

The present invention relates to a carriage for a wall saw.

BACKGROUND

Track-guided wall saw systems that include a wall saw and a guide track are known for machining hard substrates. The guide track is fastened directly or via track feet to the substrate to be machined; walls, ceilings, and floors may be machined. The wall saw is made up of a saw head with an adjustable saw arm, to which a saw blade is fastened and which is driven about a rotation axis, and a motor-driven feed unit with a guide slide and a feed motor. The wall saw together with the guide slide is situated on the guide track. The guide slide includes a gearwheel that is connected to the feed motor in a force- and torque-transmitting manner, and multiple guide elements; the guide track includes a toothed rack and multiple guide surfaces, the geometry of the guide surfaces being adapted to the geometry of the guide elements. When the wall saw is situated on the guide track, the gearwheel of the guide slide engages with the toothed rack of the guide track, and the guide slide is moved along the guide track by the feed motor. Linear guiding of the wall saw takes place via the guide elements, which are guided along the guide surfaces of the guide track. The guide elements may be designed as roller elements or as guide slide elements.

The known wall saw systems made up of a wall saw and a guide track have the disadvantage that the guide track must be fastened to the floor. For this purpose, boreholes must be provided and fastening anchors must be introduced into the boreholes. After the floor is machined, the fastening anchors may have to be removed from the boreholes, and the boreholes closed. For machining tasks with long saw cuts, fastening the guide track to the floor and subsequently closing the boreholes requires a great deal of time for the preparatory and follow-up work.

In addition to the known wall saw systems, which are suitable for machining walls, ceilings, and floors, floor saws are known which are provided for machining floors. Floor saws refer to saws that are not guided on a guide track, but, rather, are moved via a carriage with at least three wheels. Fairly small floor saws frequently include manual lowering devices and feed devices, while for larger floor saws the lowering devices and feed devices are motor-controlled. It is disadvantageous that the floor saws are suitable for machining floors, and the machining of walls and ceilings requires an additional saw.

For its track-guided Model CC1600 wall saw, the equipment manufacturer DIAMOND PRODUCTS offers a carriage via which the wall saw is converted into a floor saw. The carriage is made up of a base frame together with a receiving plate on which the wall saw is placed and fastened, a guide frame with a handle, and a chassis situated on the bottom side of the base frame. The chassis includes a first axle, designed as a front axle, with two front wheels, and a second axle, designed as a rear axle, with two rear wheels. It is disadvantageous that during the feed movement without motor-driven assistance, the carriage together with the wall saw must be moved by the operator across the floor to be machined.

SUMMARY OF THE INVENTION

It is an object of the present invention to provide a carriage for a wall saw which provides motor-driven assistance for the operator during the feed movement, with little equipment outlay.

According to the present invention, the carriage is characterized in that at least one wheel of the chassis is designed to be connectable to a gearwheel of the guide slide in a force- and torque-transmitting manner with the aid of a connection device. A connection device that connects a wheel of the chassis to the gearwheel of the guide slide in a force- and torque-transmitting manner has the advantage that the feed motor may be used as a drive motor for the carriage. The motor-driven assistance of the operator during the feed movement of the carriage may be achieved with little equipment outlay, since for a wall saw the feed motor is present, and an additional drive motor for the carriage may be dispensed with.

In one preferred embodiment, the connection device includes at least one gearwheel that is connectable to the gearwheel of the guide slide in a force- and torque-transmitting manner. A connection, designed as a gear mechanism, between the wall saw and the carriage may be easily implemented. The wall saw is placed on the receiving plate of the carriage and locked to the receiving plate. In the locked state, the gearwheel of the guide slide engages with the gearwheel of the connection device and precludes the transmission of force and torque from the guide slide to the carriage.

The connection device particularly preferably includes a first gearwheel and a second gearwheel, the first or second gearwheel being connectable to the gearwheel of the guide slide in a force- and torque-transmitting manner. For track-guided wall saws, the saw blade is fastened to an adjustable saw arm and offset with respect to a center plane of the saw head. To be able to make edge cuts on the floor at oppositely situated sides, it is necessary to place the wall saw on the carriage in two different configurations, referred to as the left configuration and the right configuration. In the left configuration of the wall saw, the saw arm together with the saw blade is situated on the left side of the carriage, the side of the carriage facing the left hand of the operator on the guide frame being defined as the left side. Correspondingly, the configuration in which the saw arm is situated on the right side of the carriage is referred to as the right configuration of the wall saw. A connection device with two gearwheels allows the wall saw to be connected to the carriage in the left and right configurations. In the left or right configuration of the wall saw, the first gearwheel of the connection device is engaged with the gearwheel of the guide slide, and in the opposite configuration, i.e., the right or left configuration, the second gearwheel of the connection device is engaged with the gearwheel of the guide slide.

In one refinement, a transmission device is provided which is situated between the first or second gearwheel of the connection device and the first axle and/or second axle in a force- and torque-transmitting manner. The transmission device connects the gearwheel of the connection device, which is engaged with the gearwheel of the guide slide, to the drive axle of the carriage in a force- and torque-transmitting manner. Since cooling water is often necessary and a large amount of dust and dirt arises when making saw cuts, a chain gear is suited as the transmission device. Due to the open chain links, chain gears are better suited for dirty machining conditions than, for example, a belt gear having a closed belt. With a belt the dirt may accumulate, whereas with open chain links of a chain it is more difficult for dirt to accumulate, and the dirt may fall through the chain links.

A coupling device that is adjustable between an engaged state and a disengaged state is particularly preferably provided, in the engaged state the gearwheel of the connection device being connected to the at least one wheel in a force- and torque-transmitting manner, and in the disengaged state the transmission of force and torque from the gearwheel of the connection device to the at least one wheel being interrupted. For track-guided wall saws, the gear for the feed motor has a self-locking design for safety reasons. When the wall saw is mounted on a wall, it must be ensured that the wall saw does not carry out any uncontrolled feed movement in the event of a power interruption. As a result of the self-locking gear for the feed motor, the carriage with a mounted wall saw can be moved only when there is a power supply. A coupling device that interrupts the transmission of force and torque to the drive axle allows the carriage with a mounted wall saw to be moved even when there is no power supply.

The coupling device is particularly preferably adjustable between the engaged state and the disengaged state via a foot switch. The design of the actuating element for the coupling device as a foot switch has the advantage that the operator may operate the coupling device when both hands are gripping the handle of the guide frame.

In one preferred embodiment, the receiving plate includes at least one retaining element that is engageable with at least one guide element of the guide slide. In a track-guided wall saw system, the guide elements of the guide slide cooperate with the guide surfaces of the guide track and are part of the linear guiding. The linear guiding (sliding movement or rolling movement) is prevented via a retaining element that is engageable with at least one guide element of the guide slide, and the guide slide is held on the receiving plate in an intended position.

The receiving plate particularly preferably includes multiple retaining elements that are engageable with the guide elements of the guide slide. The retaining elements are situated diagonally opposite one another, so that the wall saw is held on the carriage in the left configuration as well as in the right configuration. In one particularly preferred embodiment, one retaining element is provided on the receiving plate for each guide element of the guide slide. The position of the guide slide on the receiving plate is also very stable during operation of the saw when each guide element is engageable with an appropriate retaining element.

In one preferred embodiment, at least one counterweight that is fastenable to the supporting frame is provided on the carriage. The counterweight is made up of one or multiple weight element(s) that are mountable on and dismountable from the supporting frame; the counterweight is fastenable to a plug bolt or some other suitable fastening element that may accommodate a weight element or multiple weight elements. The weight distribution of the wall saw on the carriage affects the saw operation. To achieve uniform advancement of the saw blade, the drive wheels must have good traction and the saw blade must be held in the substrate. A counterweight that is situated in the area of the drive axle improves the traction of the drive axle. When the drive axle is loaded with a counterweight, the drive wheels have good contact with the floor, and slipping of the drive wheels is avoided.

A first counterweight and a second counterweight are particularly preferably provided on the carriage, the first counterweight being situated in the area of the first axle and the second counterweight being situated in the area of the second axle. To be able to maneuver a carriage together with a wall saw, the carriage is tilted by the operator via the guide frame and moved on two wheels. The maneuverability of the carriage is affected by the weight distribution of the wall saw on the carriage. For a saw head with a pivotable saw arm, the weight distribution of the wall saw varies with the pivot angle and the pivot direction of the saw arm. In addition, the configuration of the wall saw on the carriage affects the weight distribution; the right configuration of the wall saw may have a different weight distribution than the left configuration of the wall saw. Multiple counterweights are provided on the carriage to allow the weight distribution to be changed. The first counterweight is provided in the area of the first axle, and the second counterweight is provided in the area of the second axle.

At least one first plug bolt and at least one second plug bolt are particularly preferably provided on the supporting frame, the first counterweight being fastenable to the first plug bolt and the second counterweight being fastenable to the second plug bolt. The plug bolts allow simple assembly and disassembly of weight elements so that the counterweights may be adjusted to the weight distribution of the wall saw on the carriage, and to the task. The first counterweight is made up of one or multiple weight element(s) that is/are attached to the first plug bolt, and the second counterweight is made up of one or multiple weight element(s) that is/are attached to the second plug bolt. The weight elements may have the same mass, in which case different counterweights are achieved via the number of weight elements, or weight elements having different masses are used. The carriage includes a set of multiple weight elements having different masses.

In one preferred embodiment, two wheels of the chassis, which are situated on a shared drive shaft of the first or second axle, are connectable to the gearwheel of the guide slide in a force- and torque-transmitting manner, one wheel being decoupleable from the drive shaft. When both drive wheels are coupled to the drive shaft, the maneuverability of the carriage is limited without motor-driven feed movement. As the result of decoupling one drive wheel from the drive shaft, the two drive wheels may roll on the floor independently of one another, and steering movements with the carriage are simplified for the operator.

The wheel that is decoupleable from the drive shaft is particularly preferably decoupled from the drive shaft in the disengaged state of the coupling device. The coupling device is necessary for interrupting the transmission of force and torque to the drive axle when the carriage with a mounted wall saw is to be moved without a power supply. Since the decoupling of the two drive wheels is necessary when the carriage is moved without motor-driven assistance, the combination of decoupling the drive wheel from the drive shaft and disengaging the coupling device is useful. Due to the combination, the equipment outlay may be reduced and the operating comfort for the operator may be increased. The operator only needs to actuate the actuating element of the coupling device.

BRIEF DESCRIPTION OF THE DRAWINGS

Exemplary embodiments of the present invention are described below with reference to the drawings. The drawings do not necessarily illustrate the exemplary embodiments to scale, but, rather, are depicted in schematic and/or slightly distorted form when this is useful for the explanation. With respect to additions to the teaching which are directly apparent from the drawings, reference is made to the relevant prior art. In this regard, it is noted that a variety of modifications and alterations regarding the form and the detail of a specific embodiment may be made without departing from the general concept of the present invention. The features of the present invention provided in the description, the drawings, and the claims may be important to the refinement of the present invention, taken alone as well as in any given combination. In addition, any combination composed of at least two of the features provided in the description, the drawings, and/or the claims falls within the scope of the present invention. The general concept of the present invention is not limited to the exact form or the detail of the preferred specific embodiment illustrated and described below, or is not limited to a subject matter which would be delimited in comparison to the subject matter claimed in the claims. For given dimension ranges, values within the stated limits are also intended to be provided as limiting values, and may be used and claimed as desired. For the sake of simplicity, the same reference numerals are used below for identical or similar parts or parts having an identical or similar function.

FIGS. 1A, B show a known wall saw system that includes a guide track and a wall saw made up of a saw head and a motor-driven feed unit (FIG. 1A), the wall saw being movable along the guide track with the aid of a guide slide (FIG. 1B);

DETAILED DESCRIPTION

Figure 2A:
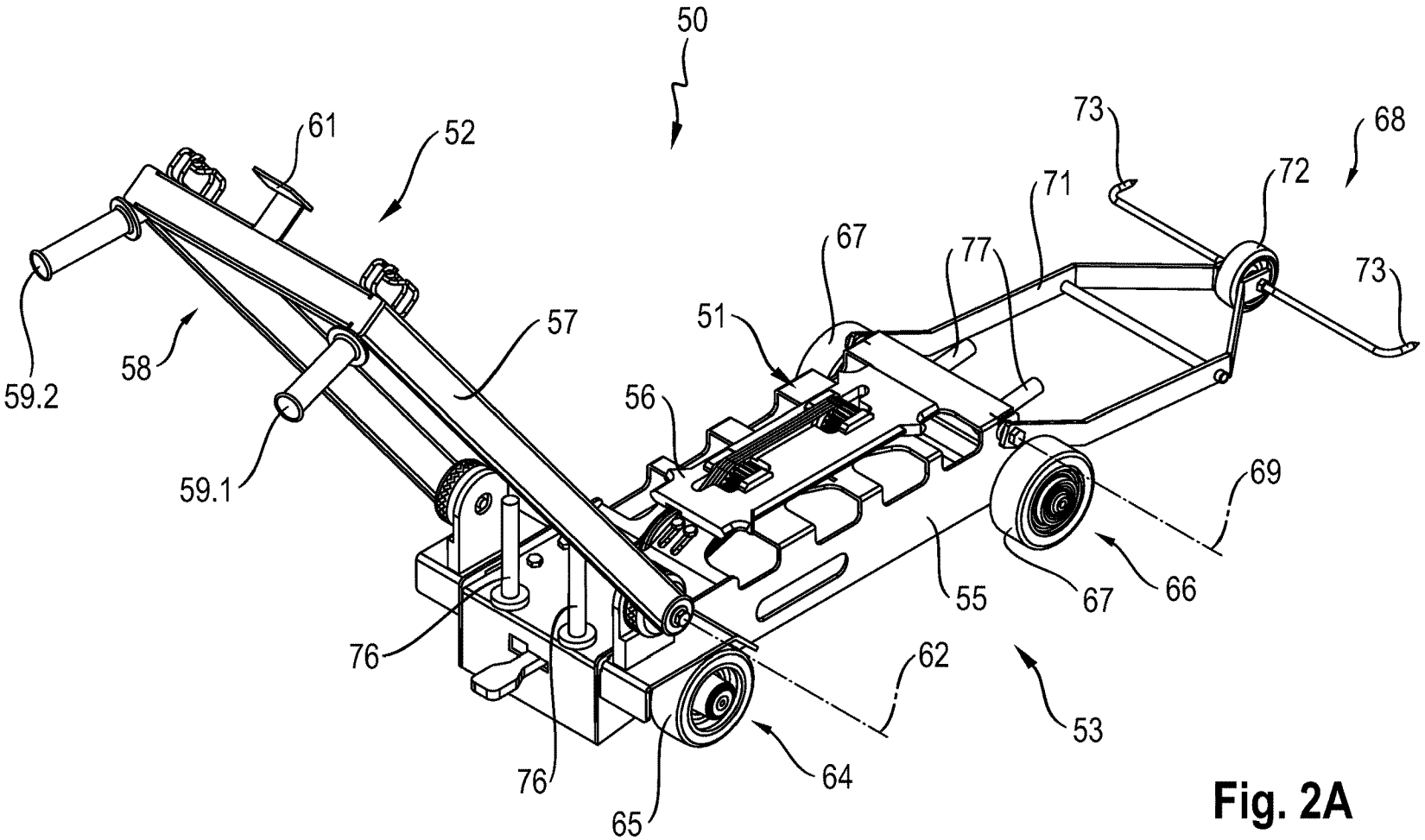
FIGS. 2A, B show a carriage according to the present invention, made up of a base frame, a guide frame, and a chassis, in the unfolded state (FIG. 2A) and with a wall saw situated on the carriage (FIG. 2B)

FIG. 1A shows a known wall saw system 10 which includes a guide track 11, a wall saw 12 that is displaceably situated on guide track 11, and a remote control unit 13. Wall saw 12 includes a machining unit 14 and a motor-driven feed unit 15. The machining unit is designed as a saw head 14, and includes a saw blade 16 that is fastened to a saw arm 17 and driven about a rotation axis 19 by a drive motor 18. For protection of the operator, saw blade 16 is surrounded by a blade guard 21, which is fastened to saw arm 17 with the aid of a blade guard holder.

Saw arm 17 is designed to be pivotable about a pivot axis 23 by a swivel motor 22. The pivot angle of saw arm 17 determines, via a diameter of saw blade 16, the depth of submersion of saw blade 16 into a workpiece 24 to be machined. Drive motor 18 and swivel motor 22 are situated in a device housing 25. As an alternative to the pivoting movement of saw arm 17 about pivot axis 23, saw arm 17 may be moved, for example, with the aid of a linear drive or some other drive device.

Motor-driven feed unit 15 includes a guide slide 26, and a feed motor 27 which in the exemplary embodiment is likewise situated in device housing 25. Saw head 14 is fastened to guide slide 26, and is designed to be displaceable along guide track 11 in a feed direction 28 via feed motor 27. In addition to motors 19, 22, 27, a control unit 29 for controlling saw head 14 and motor-driven feed unit 15 is situated in device housing 25. Guide slide 26 and saw head 14 may have a one-piece design, or guide slide 26 is designed as a separate component to which saw head 14 is fastened.

Remote control unit 13 includes a device housing 31, an input device 32, a display device 33, and a control unit 34 that are situated in the interior of device housing 31. Control unit 34 converts the inputs of input device 32 into control commands and data, which are transmitted to wall saw 12 via a first communication link. The first communication link is designed as a wireless and cordless communication link 35 or as a communication cable 36. Wireless and cordless communication link 35 may be designed in the form of a radio, infrared, Bluetooth, WLAN, or Wi-Fi connection.

FIG. 1B shows the design of guide slide 26 and the connection between guide slide 26 and guide track 11. Guide slide 26 is designed as a separate component; saw head 14 is inserted into guides 41 and fastened to guide slide 26. Guide track 11 is designed as a hollow profile, and includes a toothed rack 42 and two guide surfaces 43.1, 43.2. The term "toothed rack" encompasses all rod-shaped elements having a toothed profile; a toothed rack together with a gearwheel forms a rack and pinion gear.

Guide slide 26 includes a base body 44, a gearwheel 45, and four guide elements 46.1, 46.2, 47.1, 47.2. The gearwheel is designed as a spur gear 45 and is supported on an axle 48. When a wall saw is fixed to guide track 11, gearwheel 45 of guide slide 26 engages with toothed rack 42 of guide track 11, and the rotatory movement of feed motor 27 is converted into a translatory movement along guide track 11 via the rack and pinion gear made up of gearwheel 45 and toothed rack 42. The guide elements in the exemplary embodiment are designed as guide rollers 46.1, 46.2, 47.1, 47.2 which carry out a rolling movement along guide surfaces 43.1, 43.2. Guide rollers 46.1, 46.2 are designed as stationary guide rollers, and guide rollers 47.1, 47.2 are designed as pivotable guide rollers.

Figure 2B:
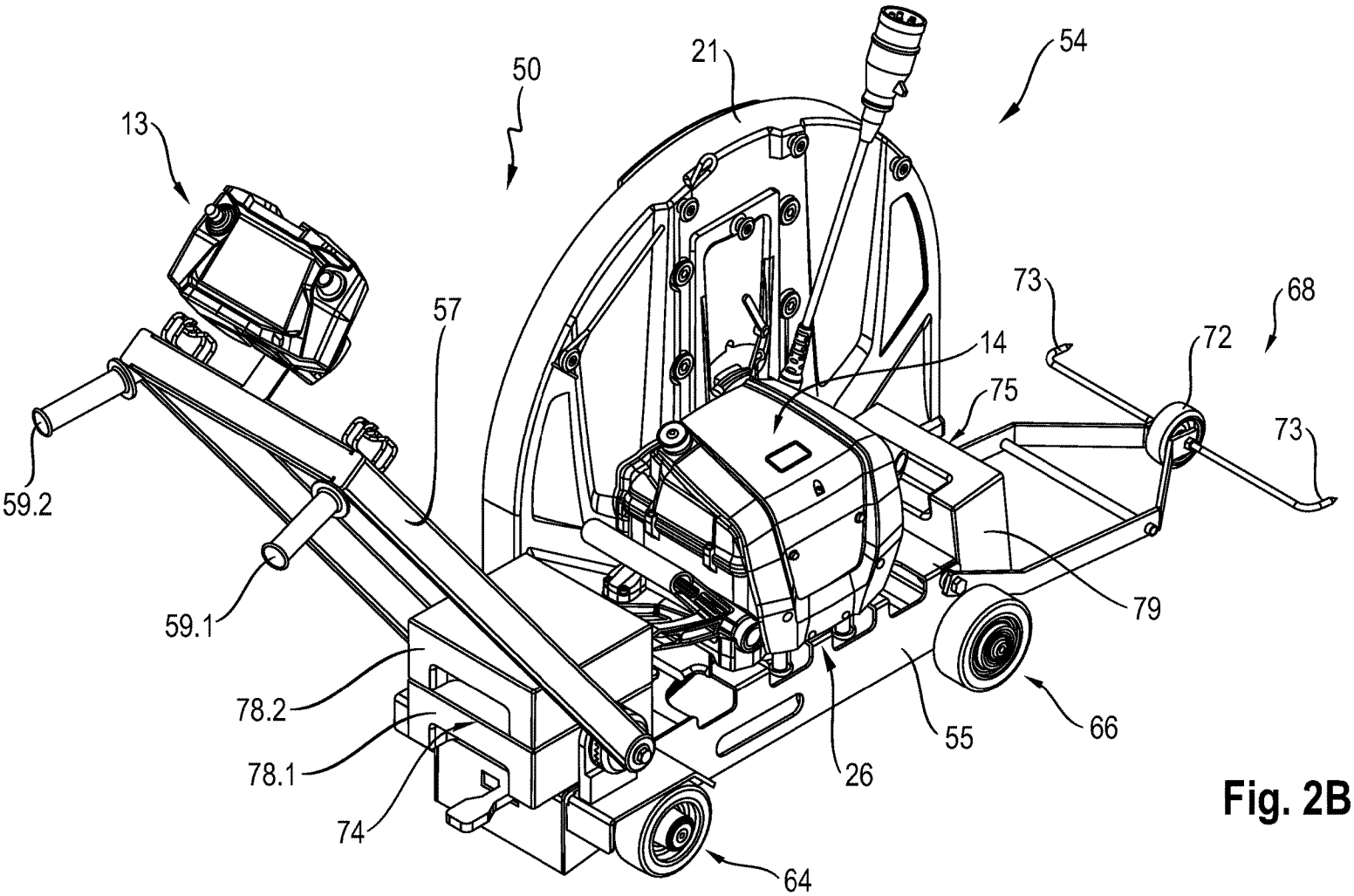

FIGS. 2A, B show a carriage 50 according to the present invention, made up of a base frame 51, a guide frame 52, and a chassis 53. FIG. 2A shows carriage 50 in the unfolded state, and FIG. 2B shows carriage 50 with a wall saw 54 situated on carriage 50. The design of wall saw 54 corresponds to that of wall saw 12, including saw head 14 and motor-driven feed unit 15, shown in FIG. 1A.

Base frame 51 is designed as a supporting frame structure, and includes a supporting frame 55 and a receiving plate 56 via which wall saw 54 is connected to carriage 50. Supporting frame 55 is connected to chassis 53 at the bottom side, facing the floor to be machined, and connected to receiving plate 56 at the top side.

Guide frame 52 is designed as a U-shaped frame 57, which is connected at the closed end to a handle 58 for guiding carriage 50, and is connected at the open end to supporting frame 55. Handle 58 includes a right grip element 59.1 and a left grip element 59.2, which in the exemplary embodiment are rigidly connected to frame 57; alternatively, the grip elements may have a design that is adjustable with respect to frame 57. In addition, a holder 61 is provided at the closed end of frame 57 which may accommodate remote control unit 13 of wall saw 54. Guide frame 52 is adjustable relative to supporting frame 55 about a pivot axis 62. The height of handle 58 and the distance from saw head 14 may be changed by adjusting the pivot angle between supporting frame 55 and guide frame 52.

Chassis 53 includes a first axle 64, designed as a rear axle, with two wheels 65, and a second axle 66, designed as a front axle, with two wheels 67; the wheels situated on front axle 66 are referred to as front wheels 67, and the wheels situated on rear axle 64 are referred to as rear wheels 65. In the exemplary embodiment, rear axle 64 is driven and front axle 66 is not driven; alternatively, the front axle may be driven and the rear axle not driven, or the front and rear axles are jointly driven.

To assist the operator in making a cut, carriage 50 includes a cut indicator device 68 which is provided on the front side of supporting frame 55 facing away from guide frame 52. Cut indicator device 68 is designed to be pivotable about a pivot axis 69, and includes a frame element 71, a supporting wheel 72, and an indicator element 73. In the exemplary embodiment, wall saw 54 is situated in such a way that saw blade 16 and blade guard 21, as viewed by the operator, are situated on the left side of carriage 50; this configuration of wall saw 54 is referred to as the left configuration. The left end of indicator element 73 shows the operator the position of saw blade 16, and thus the cut line. When wall saw 54 is placed on receiving plate 56 in such a way that saw blade 16 and blade guard 21, as viewed by the operator, are situated on the right side of carriage 50, which is referred to as the right configuration, the right end of indicator element 73 indicates the cut line.

In the exemplary embodiment, rear and front wheels 65, 67 do not have a steerable design. To nevertheless be able to maneuver carriage 50 together with wall saw 54, carriage 50 is tilted backward by the operator via guide frame 52 and moved on rear wheels 65. The maneuverability of carriage 50 is affected by the weight distribution of wall saw 54 on carriage 50. For a saw head 14 with a pivotable saw arm 17, the weight distribution of wall saw 54 changes with the pivot angle and the pivot direction of saw arm 17. In addition, the configuration of wall saw 54 on carriage 50 affects the weight distribution; the right configuration of wall saw 54 may have a different weight distribution than the left configuration of wall saw 54.

Multiple counterweights are provided on carriage 50 to allow the weight distribution on carriage 50 to be changed. A first counterweight 74 is provided in the area of rear axle 64, and a second counterweight 75 is provided in the area of front axle 66. First and second counterweights 74, 75 are fastened to supporting frame 55. For this purpose, first plug bolts 76 and second plug bolts 77 are provided on supporting frame 55, onto which weight elements 78.1, 78.2, 79 may be pushed. First counterweight 74 is made up of the two weight elements 78.1, 78.2, which are attached to first plug bolts 76 and stacked one on top of the other. Second counterweight 75 is made up of weight element 79, which is attached to second plug bolts 77.

In the exemplary embodiment, weight elements 78.1, 78.2, 79 have the same weight; alternatively, weight elements having the same weight may be used with another mass, or weight elements having different masses are used. Plug bolts 76, 77 allow simple assembly and disassembly of weight elements 78.1, 78.2, 79 so that counterweights 74, 75 may be adapted to the weight distribution of wall saw 54 on carriage 50. Carriage 50 includes a set of multiple weight elements having different masses, which may be attached to plug bolts 76, 77 as needed.

The weight distribution of wall saw 54 on carriage 50 also affects the operation of the saw. To achieve uniform advancement of saw blade 16, the drive wheels must have good traction and saw blade 16 must be held in the substrate to be machined. First counterweight 74 is situated on rear axle 64 to improve the traction of rear axle 64. When drive axle 64 is loaded with a counterweight, drive wheels 65 have good contact with the floor, and slipping of drive wheels 65 is avoided. Second counterweight 75 is situated in the area of front axle 64 in order to hold saw blade 16 in the substrate and to prevent upward movement of saw blade 16.

Figure 3:
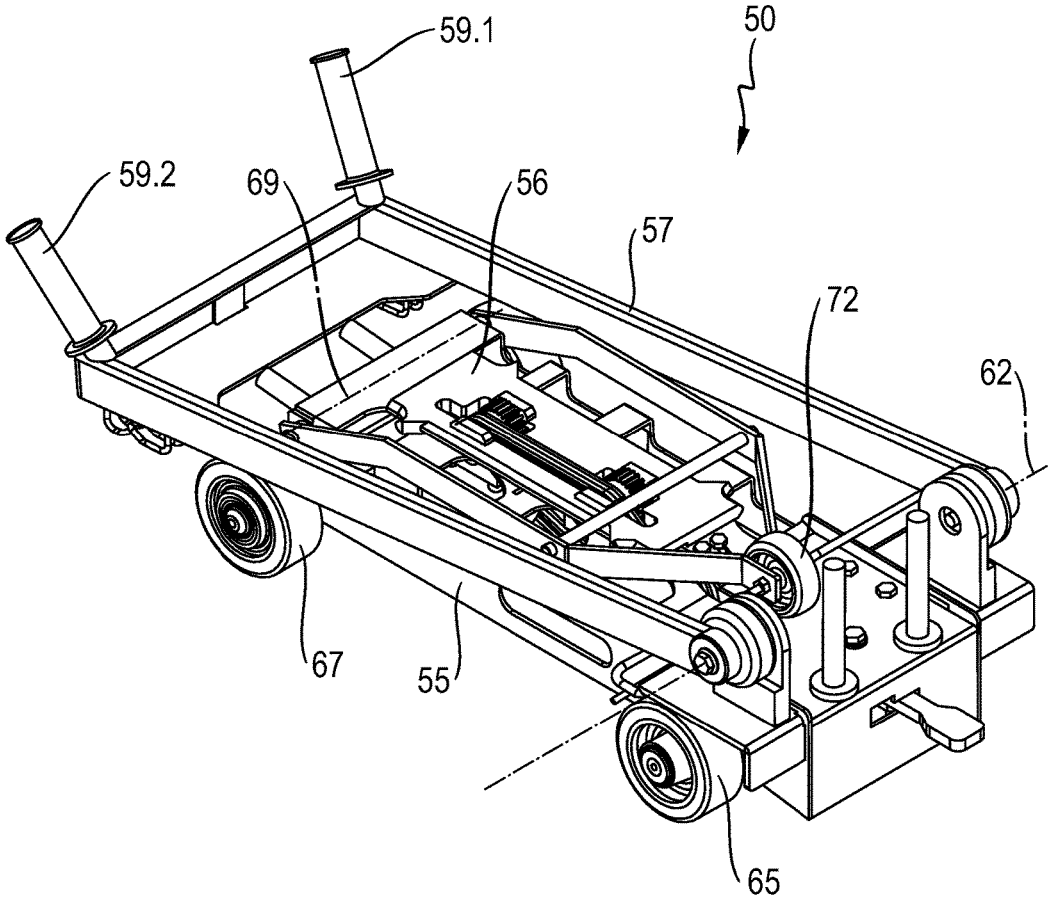
FIG. 3 shows the carriage according to the present invention from FIG. 2A, in a three-dimensional view in the folded-up state.

FIG. 3 shows carriage 50 according to the present invention from FIG. 2A, in a three-dimensional view in the folded-up state. For transport, carriage 50 may be folded up and stowed as a compact unit. The folding up of carriage 50 takes place starting from the unfolded state illustrated in FIG. 2A.

Cut indicator device 68 and frame 57 of guide frame 52 are designed to be pivotable about pivot axes in parallel to the rotation axis of the rear axle; cut indicator device 68 is pivotable about pivot axis 69, and frame 57 is pivotable about pivot axis 62. Starting from the unfolded state of carriage 50 illustrated in FIG. 2A, cut indicator device 68 is initially pivoted by approximately 180° about pivot axis 69; in this position, supporting wheel 72 rests on supporting frame 55. For folding in frame 57, a screw is loosened and frame 57 is pivoted by approximately 90° about pivot axis 62, after which the screw is tightened.

Figure 4A:
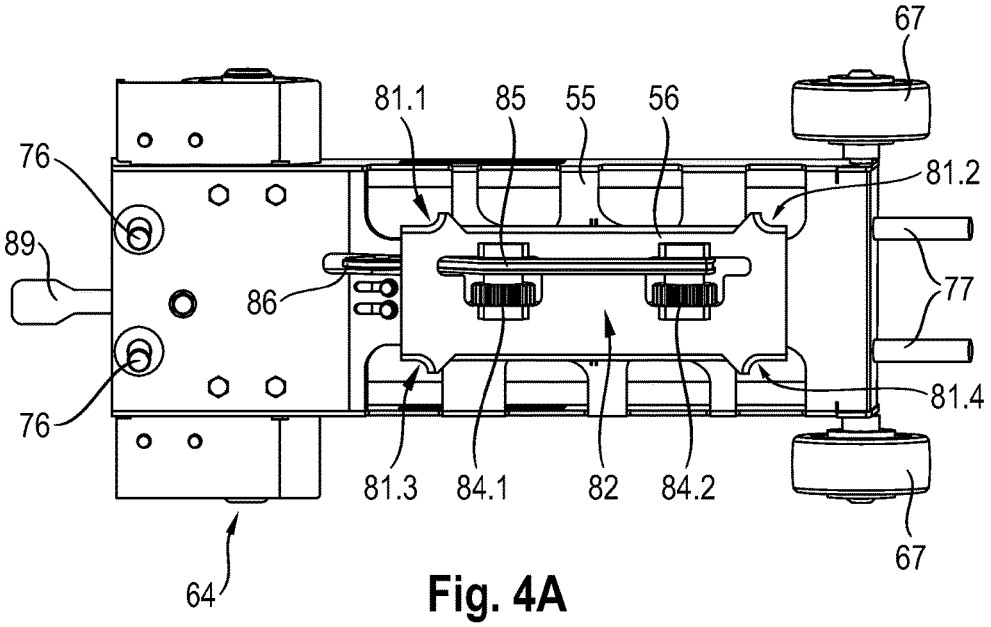
FIGS. 4A, B show the base frame of the carriage according to the present invention from FIG. 2A, in a view from above (FIG. 4A) and in a view from below (FIG. 4B) onto the chassis of the carriage, together with a coupling device.
Figure 4B:
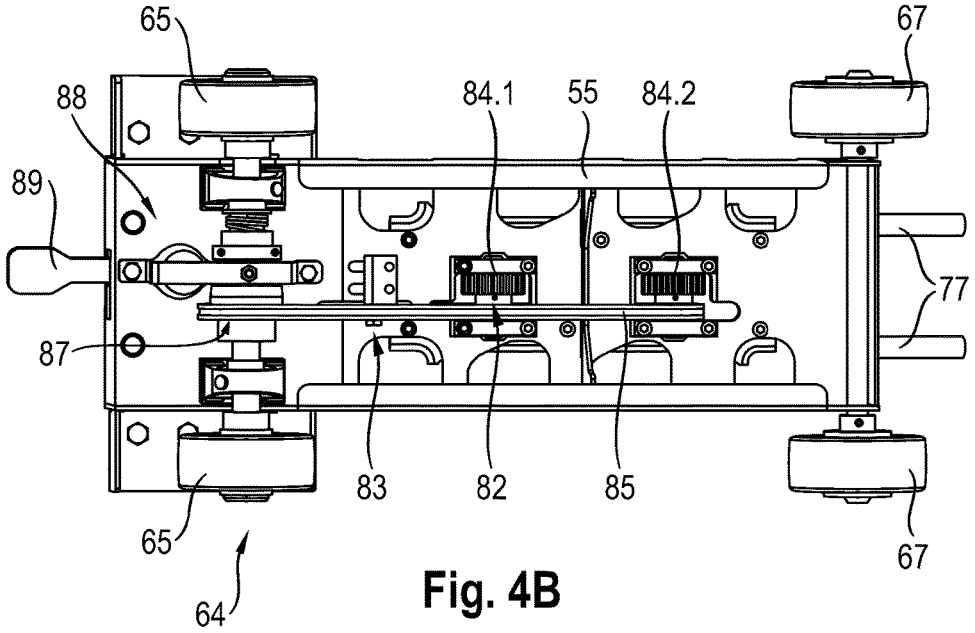

FIGS. 4A, B show base frame 51 of carriage 50 according to the present invention from FIG. 2A, in a view from above onto receiving plate 56 (FIG. 4A) and in a view from below onto chassis 53 (FIG. 4B). To convert wall saw 54 into a floor saw with motor-driven feed movement with the aid of carriage 50, on the one hand wall saw 54 must be securely fastened to carriage 50, and on the other hand, feed motor 27 of wall saw 54 must be connected to rear axle 64 in a force- and torque-transmitting manner.

The fastening of wall saw 54 to carriage 50 takes place via receiving plate 56, which is fastened to the top side of supporting frame 55. Wall saw 54 together with guide slide 26 is placed on receiving plate 56. Receiving plate 56 includes four retaining elements 81.1, 81.2, 81.3, 81.4 which are engageable with guide elements 46.1, 46.2, 47.1, 47.2 of guide slide 26. Retaining elements 81.1 through 81.4 ensure that the guide elements of guide slide 26, designed as guide rollers 46.1, 46.2, 47.1, 47.2, do not carry out a rolling movement.

After wall saw 54 is placed on receiving plate 56, stationary guide rollers 46.1, 46.2 of guide slide 26 rest against retaining elements 81.1, 81.2 of receiving plate 56. Movable guide rollers 47.1, 47.2 of guide slide 26 are subsequently pivoted with the aid of the handle until movable guide rollers 47.1, 47.2 rest against retaining elements 81.3, 81.4 of receiving plate 56. When wall saw 54 is placed on carriage 50 in the right configuration, stationary guide rollers 46.1, 46.2 of guide slide 26 rest against retaining elements 81.3,

81.4, and movable guide rollers 47.1, 47.2 rest against retaining elements 81.1, 81.2.

The drive of rear axle 64 is provided via feed motor 27 and a gear of wall saw 54 associated with feed motor 27. The movement of feed motor 27 is transmitted via the associated gear to gearwheel 45 of guide slide 26. The rotatory movement of gearwheel 45 is transmitted to rear axle 64 via a connection device 82, and a transmission device designed as a chain gear 83. Connection device 82 together with gearwheel 45 of guide slide 26 form a form-fit gear mechanism.

In the exemplary embodiment in FIGS. 4A, B, connection device 82 includes two gearwheels 84.1, 84.2, which are connectable to gearwheel 50 of guide slide 26 in a force- and torque-transmitting manner. First gearwheel 84.1 of connection device 82 is engaged with gearwheel 45 of guide slide 26 when wall saw 54 is situated on carriage 50 in the left configuration. Second gearwheel 84.2 of connection device 82 is engaged with gearwheel 45 of guide slide 26 when wall saw 54 is situated on carriage 50 in the right configuration. When the gearwheel of guide slide 26 is situated in the middle of guide slide 26, one gearwheel is sufficient to connect guide slide 26 to carriage 50 in the right and left configurations. For large, heavy wall saws, it may be necessary to provide different receiving plates for the right and left configurations of the wall saw on the carriage.

The transmission device is designed as a chain gear 83, and includes a chain 85, a tension roller 86, and a sprocket 87 that is supported on rear axle 64. Chain 85 transmits the rotation of first or second gearwheel 84.1, 84.2 of connection device 82 to sprocket 87. Tension roller 86 ensures uniform feed movement and reduces a jerking motion of the carriage during operation of the saw. Due to the open chain links, chain gear 83 is less susceptible to soiling than, for example, a belt gear with a closed belt. With a belt gear the dirt may accumulate on the closed belt, whereas it is more difficult for dirt to accumulate in open chain links, and the dirt may fall through the chain links.

For track-guided wall saws, such as wall saw 12 shown in FIG. 1A and wall saw 54 shown in FIG. 2*b*, the gears for swivel motor 22 and feed motor 27 have a self-locking design for safety reasons. When wall saw 12, 54 is mounted on a wall, in the event of a power interruption it must be ensured that wall saw 12, 54 does not carry out any uncontrolled feed movement, and that saw arm 17 does not move uncontrolled about pivot axis 23. As a result of the self-locking gear for feed motor 27, carriage 50 with a mounted wall saw 54 can be moved only when there is a power supply. To allow carriage 50 with a mounted wall saw 54 to be moved even when there is no power supply, transmission device 83 includes a coupling device 88 that is actuatable via an actuating element that is designed as a foot switch 89.

Figure 5A:
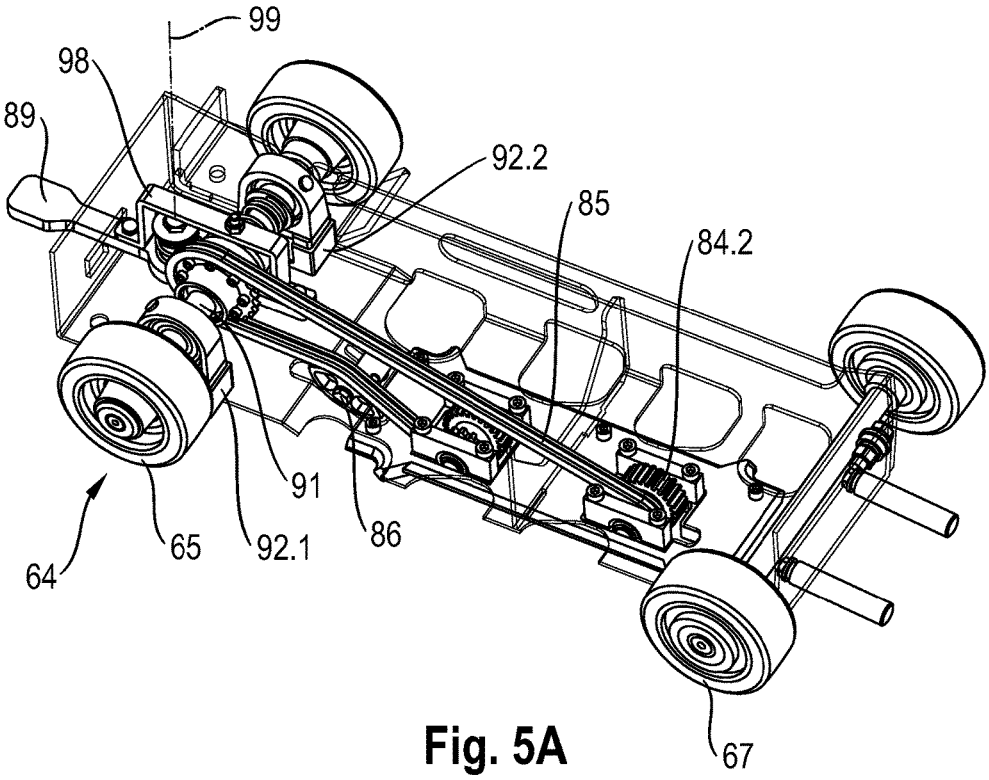
FIGS. 5A, B show the chassis (FIG. 5A) and the driven rear axle (FIG. 5B) of the carriage according to the present invention from FIG. 2A, with the coupling device in the engaged state.
Figure 5B:
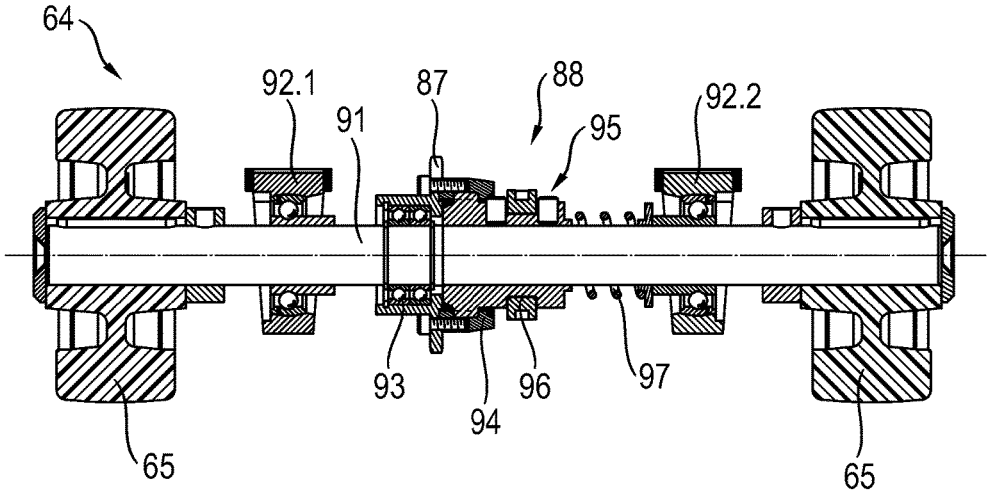

FIGS. 5A, B show chassis 53 of carriage 50 according to the present invention and driven rear axle 64 in the engaged state of coupling device 88. FIG. 5A shows coupling device 88, which connects rear axle 64 to feed motor 27 in a force- and torque-transmitting manner, and FIG. 5B shows rear axle 64 in a sectional view.

Rear axle 64 together with the two rear wheels 65 is driven via feed motor 27, the gear associated with feed motor 27, gear mechanism 45, 82 (gearwheel 45 and gearwheel 84.1, 84.2 of connection device 82), and chain gear 83. Rear wheels 65 are situated on a drive shaft 91 and are rotatably fixedly connected to drive shaft 91. Drive shaft 91 is supported via first and second pedestal bearings 92.1, 92.2 that are fastened to the bottom side of supporting frame 55.

Coupling device 88 includes a bearing 93, a splined hub 94, a toothed sleeve 95, an actuating ring 96, and a compression spring 97. Sprocket 87 of chain gear 83 is supported on drive shaft 91 via bearing 93, and is rotatably fixedly connected to splined hub 94. In the exemplary embodiment, sprocket 87 and splined hub 94 are designed as separate parts that are screwed together; alternatively, sprocket 87 and splined hub 94 may have a one-piece design. Toothed sleeve 95 is nonrotatably supported on drive shaft 91, and is designed to be displaceable along drive shaft 91 via actuating ring 96. Actuating ring 96 is connected to foot switch 89 via a lever 98 that is rotatably supported about a rotation axis 99, and the actuating ring is moved along drive shaft 91 during the movement of foot switch 89.

Foot switch 89 is adjustable between a first and a second position, the position of foot switch 89 illustrated in FIG. 5A being defined as the first position. In the first position of foot switch 89, toothed sleeve 95 engages with splined hub 94. Splined hub 94 has an internal geometry 101 that is designed as internal toothing, and toothed sleeve 95 has a complementary external geometry 102 that is designed as external toothing. When toothed sleeve 95 is engaged with splined hub 94, external toothing 102 of toothed sleeve 95 and internal toothing 101 of splined hub 94 establish a form fit, and drive shaft 91 together with drive wheels 65 is connected to feed motor 27 of wall saw 54 in a force- and torque-transmitting manner.

Figure 6A:
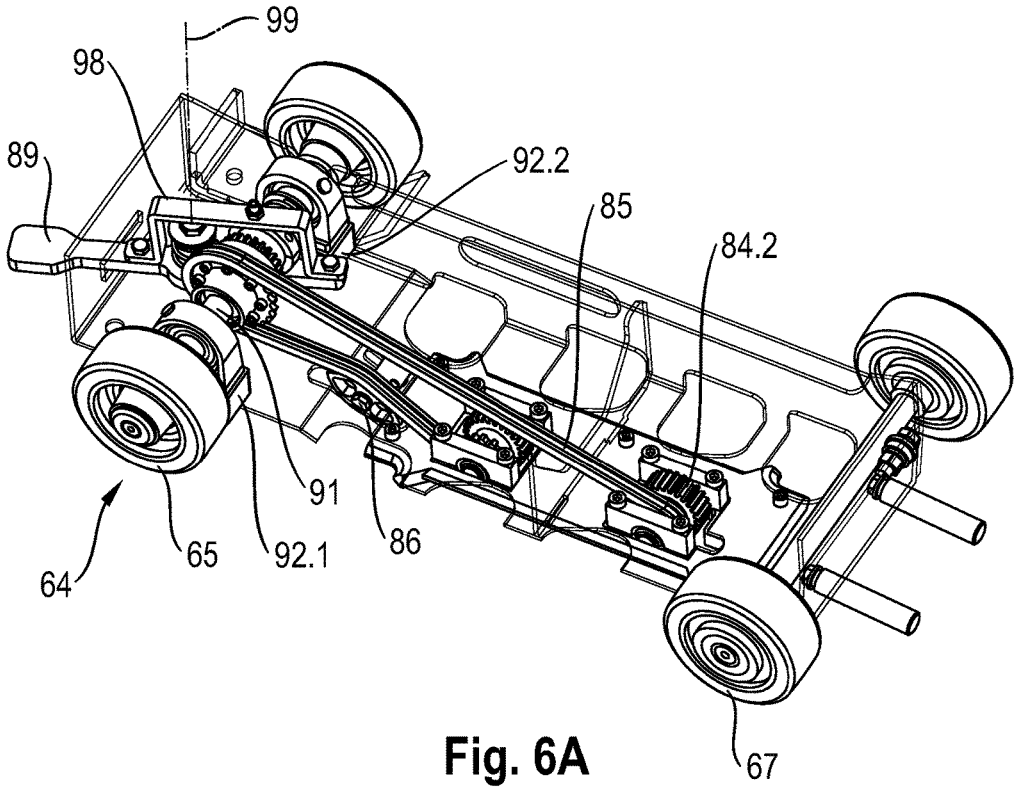
FIGS. 6A, B show the chassis (FIG. 6A) and the driven rear axle (FIG. 6B) of the carriage according to the present invention from FIG. 2A, with the coupling device in the disengaged state.
Figure 6B:
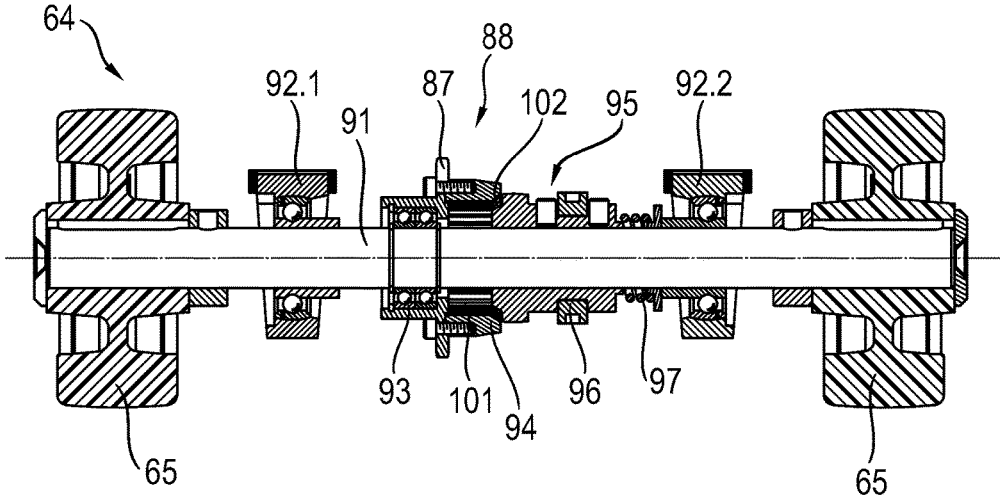

FIGS. 6A, B show chassis 53 of carriage 50 according to the present invention and driven rear axle 64 in the disengaged state of coupling device 88, the disengaged state corresponding to the second position of foot switch 89. FIG. 6A shows coupling device 88, which interrupts the transmission of force and torque from feed motor 27 to rear axle 64, and FIG. 6B shows rear axle 64 in a sectional view.

The disengagement of coupling device 88 takes place via foot switch 89, which is moved into the second position. When foot switch 89 is actuated from the first position into the second position, the spring pressure of compression spring 97 is overcome. Lever 98 acts on actuating ring 96 and moves actuating ring 96, situated on toothed sleeve 95, against compression spring 97 in the direction of second pedestal bearing 92.2. In the second position of foot switch 89, toothed sleeve 95 is not engaged with splined hub 94, and external toothing 102 of toothed sleeve 95 is not connected in a form-fit manner to internal toothing 101 of splined hub 94.

Toothed sleeve 95, which is connected to actuating ring 96, is moved from the splined hub 94, and the form fit between internal toothing 101 of splined hub 94 and external toothing 102 of toothed sleeve 95 is eliminated. Without a form fit between splined hub 94 and toothed sleeve 95, the transmission of force and torque from guide slide 26 to drive shaft 91 is interrupted. Due to the interruption of the transmission of force and torque, drive wheels 65 on drive shaft 64 with a mounted wall saw 54 may be rolled across the floor without a power supply.

When foot switch 89 is moved by the operator from the second position (FIG. 6A) into the first position (FIG. 5A), no force acts on lever 98, and toothed sleeve 95 exerts no force on compression spring 97. Compression spring 97 presses toothed sleeve 95 in the direction of splined hub 94, and the form fit between splined hub 94 and toothed sleeve 95 is established.

Figure 7A:
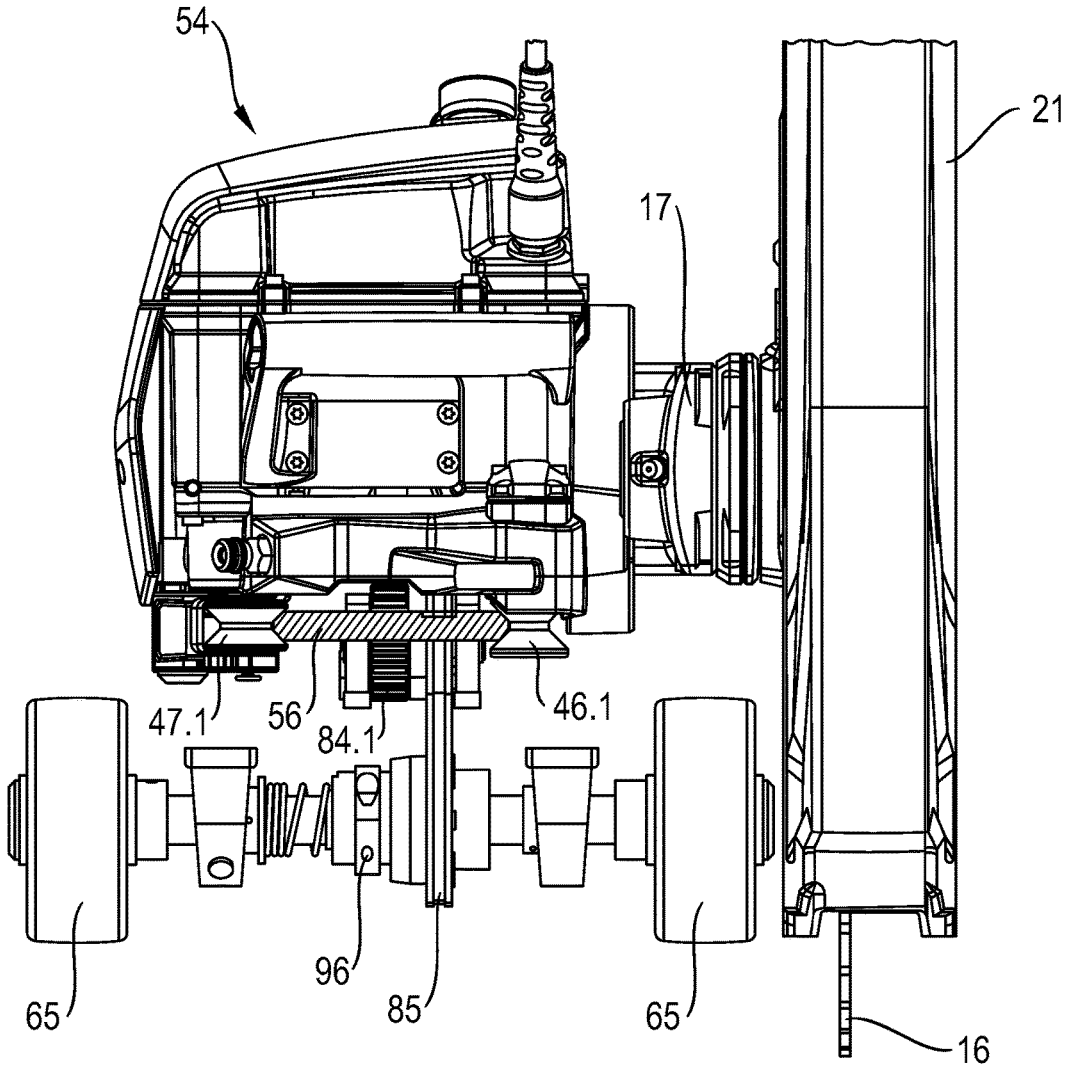
FIGS. 7A, B show the wall saw from FIG. 2B, which together with the carriage according to the present invention from FIG. 2A is designed as a floor saw (FIG. 7A), and which together with a guide track forms a wall saw system (FIG. 7B)
Figure 7B:
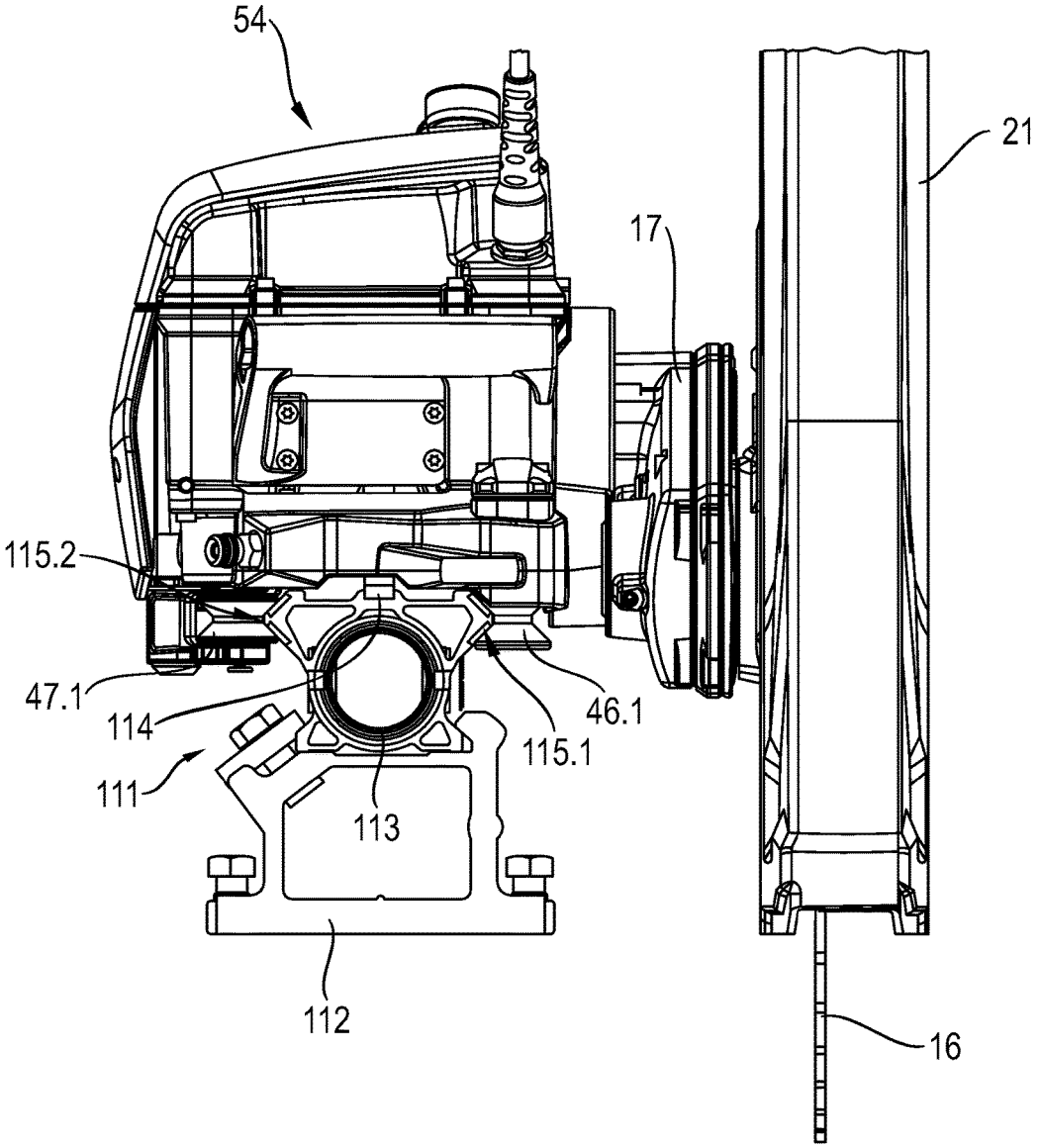

FIGS. 7A, B show wall saw 54 from FIG. 2B, which together with carriage 50 according to the present invention from FIG. 2A is designed as a floor saw (FIG. 7A), and which together with a guide track 111 forms a track-guided wall saw system (FIG. 7B). Wall saw 54 includes saw head 14 together with saw arm 17, to which saw blade 16 is fastened, and guide slide 26. Wall saw 54 is fastened to carriage 50 and to guide track 101 with the aid of guide slide 26.

In the exemplary embodiment in FIG. 2B, guide slide 26 includes two stationary guide rollers 46.1, 46.2 and two movable guide rollers 47.1, 47.2. Stationary guide rollers 46.1, 46.2 are situated on the side of saw head 14 facing saw arm 17, and movable guide rollers 47.1, 47.2 are situated on the side of saw head 14 facing away from saw arm 17.

FIG. 7A shows wall saw 54, which is fastened to carriage 50 and which together with carriage 50 forms a floor saw. Wall saw 54 together with guide slide 26 is placed on receiving plate 56 of carriage 50 in such a way that stationary guide rollers 46.1, 46.2 of guide slide 26 rest against retaining elements 81.3, 81.4 of receiving plate 56. Movable guide rollers 47.1, 47.2 of guide slide 26 are subsequently pivoted with the aid of the handle until movable guide rollers 47.1, 47.2 rest against retaining elements 81.1, 81.2 of receiving plate 56. When wall saw 54 is fixed to receiving plate 56, gearwheel 45 of guide slide 26 engages with second gearwheel 84.2 of connection device 82, and the movement of feed motor 27 is converted into a rotation of drive shaft 91 via chain gear 83.

FIG. 7B shows wall saw 54, which is fastened to guide track 101 and which together with guide track 101 forms a track-guided wall saw system. Guide track 111 is fastened via track feet 112 to the substrate to be machined, which may be designed as a wall, floor, or ceiling. Guide track 101 includes a circular tube 113 as base body, a toothed rack 114, and two V-shaped guide surfaces 115.1, 115.2, the geometry of guide surfaces 115.1, 115.2 being adapted to the geometry of guide rollers 46.1, 46.2, 47.1, 47.2 of guide slide 26.

Wall saw 54 together with guide slide 26 is placed on guide track 111 in such a way that stationary guide rollers 46.1, 46.2 of guide slide 26 rest against first guide surface 115.1. Movable guide rollers 47.1, 47.2 of guide slide 26 are subsequently pivoted with the aid of the handle until movable guide rollers 47.1, 47.2 rest against second guide surface 115.2. When wall saw 54 is fixed to guide track 111, gearwheel 45 of guide slide 26 engages with toothed rack 114 of the guide track, and the rotatory movement of feed motor 27 is converted into a translatory movement along guide track 111 via the rack and pinion gear made up of gearwheel 45 and toothed rack 114.

Figure 8A:
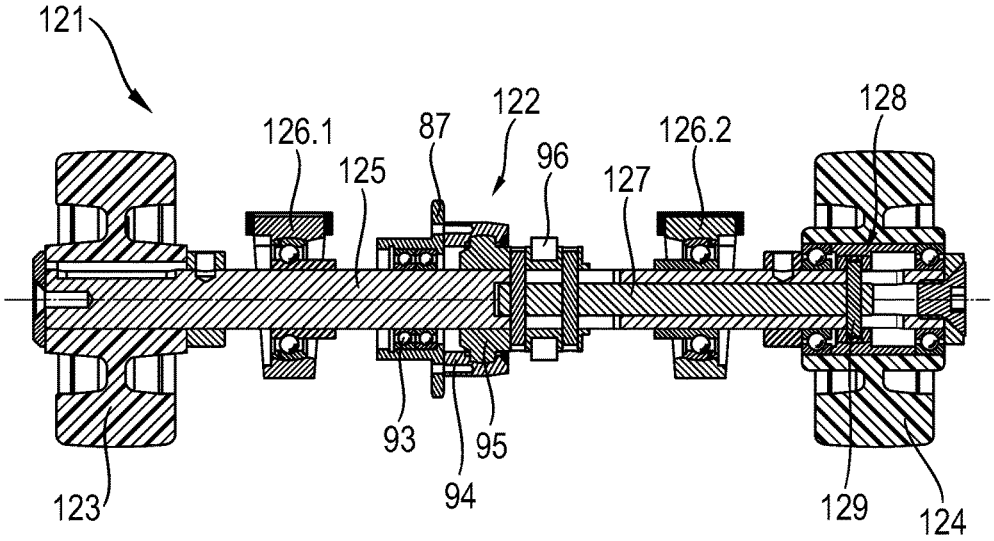
FIGS. 8A, B show one alternative embodiment of a drive axle together with a coupling device in the engaged state (FIG. 8A) and in the disengaged state (FIG. 8B).
Figure 8B:
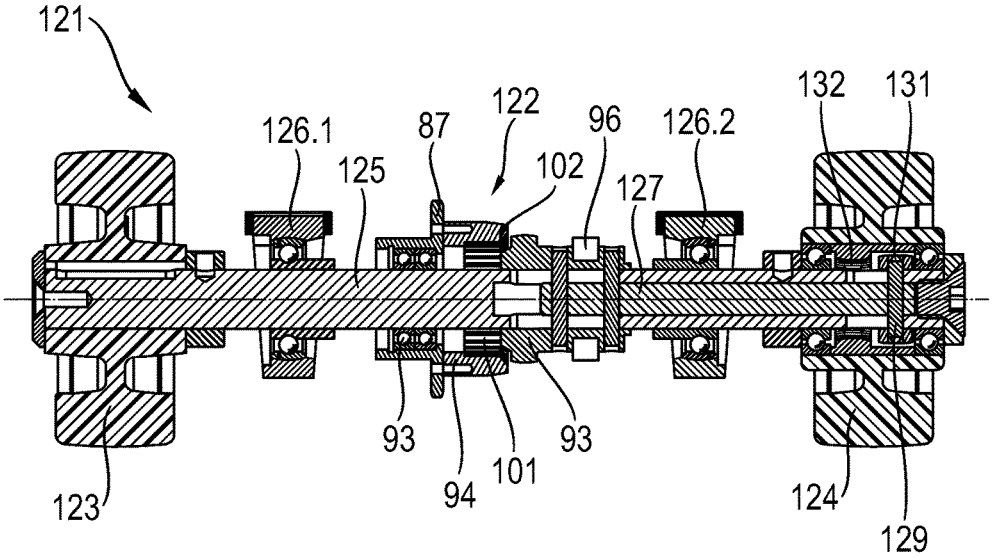

FIGS. 8A, B show one alternative embodiment of a drive axle 121 for carriage 50 according to the present invention, with a coupling device 122 in the engaged state (FIG. 8A), in which drive axle 121 is connected to feed motor 27 of wall saw 54 in a force- and torque-transmitting manner, and in the disengaged state (FIG. 8B), in which the transmission of force and torque is interrupted and drive wheels 123, 124 are decoupled from one another. In carriage 50, drive axle 121 may replace driven rear axle 64 or may be used instead of nondriven front axle 66.

Drive wheels 123, 124 are situated on a drive shaft 125, first drive wheel 123 being rotatably fixedly coupled to drive shaft 125, and second drive wheel 124 being designed to be decoupleable from drive shaft 125. Drive shaft 125 is supported via first and second pedestal bearings 126.1, 126.2 that are fastened to the bottom side of supporting frame 55.

Coupling device 122 has a design that is analogous to coupling device 88 in FIGS. 5 and 6, and is actuated via foot switch 89. Coupling device 122 includes splined hub 94, which is rotatably fixedly connected to sprocket 87 of chain gear 83, and toothed sleeve 95, which is nonrotatably supported on drive shaft 125 and designed to be displaceable along drive shaft 125 via actuating ring 96. Coupling device 122 differs from coupling device 88 in that on the end facing away from external toothing 102, toothed sleeve 95 is connected to a connecting rod 127 that is displaceably situated in drive shaft 125.

Second drive wheel 124 is supported on drive shaft 125 and is decoupleable from drive shaft 125 via a toothed gear 128. Toothed gear 128 includes a toothed disk 129 having an external toothing 131 which may establish a form fit with internal toothing 132. In the engaged state of coupling device 122, external toothing 131 is connected to internal toothing 132 in a form-fit manner, and second drive wheel 124 is rotatably fixedly connected to drive shaft 125. In the disengaged state of coupling device 122, external toothing 131 and internal toothing 132 are not connected in a form-fit manner, and second drive wheel 124 is decoupled from drive shaft 125. As a result of the decoupling of second drive wheel 124 of drive shaft 125 from first drive wheel 123, which is rotatably fixedly connected to drive shaft 125, the two drive wheels 123, 124 may roll on the floor independently of one another, and the maneuverability of carriage 50 is improved.

In the exemplary embodiment in FIGS. 8A, B, the decoupling of second drive wheel 124 from drive shaft 125 is combined with the disengagement of coupling device 122. Since the decoupling of the two drive wheels 123, 124 is necessary when carriage 50 is moved without motor-driven assistance, the combination of decoupling and disengagement is useful. Due to the combination, the equipment outlay may be reduced and the operating comfort for the operator may be increased. The operator only needs to move foot switch 89 between the first position and the second position.

What is claimed is:

1. A carriage for a wall saw, the wall saw made up of a saw head and a motor-driven feed unit with a guide slide and a feed motor, the wall saw being connectable to a toothed rack of a guide track with the aid of a gearwheel of the guide slide, and being movable along guide surfaces of the guide track with the aid of guide elements of the guide slide, the carriage comprising:

a base frame with a supporting frame and a receiving plate connectable to the wall saw;

a guide frame with a handle, the guide frame being connected to the base frame; and a chassis with a first axle, a second axle, and at least three wheels situated on the first and second axles, the chassis being situated on a bottom side of the supporting frame;

at least one wheel of the at least three wheels being connectable to the gearwheel of the guide slide in a force- and torque-transmitting manner with the aid of a connection device.

2. The carriage as recited in claim 1 wherein the connection device includes at least one carriage gearwheel connectable to the gearwheel of the guide slide in the force- and torque-transmitting manner.

3. The carriage as recited in claim 2 wherein the at least one carriage gearwheel includes a first gearwheel and a second gearwheel, the first or second gearwheel being connectable to the gearwheel of the guide slide in the force- and torque-transmitting manner.

4. The carriage as recited in claim 3 further comprising a transmission device situated between the first or second gearwheel and the first axle or second axle.

5. The carriage as recited in claim 4 further comprising a coupling device adjustable between an engaged state and a disengaged state, in the engaged state the first or second gearwheel being connected to the at least one wheel in the force- and torque-transmitting manner, and in the disengaged state transmission of force and torque from the first or second gearwheel so connected to the at least one wheel being interrupted.

6. The carriage as recited in claim 5 wherein the coupling device is adjustable between the engaged state and the disengaged state via a foot switch.

7. The carriage as recited in claim 1 wherein the receiving plate includes at least one retaining element engageable with at least one of the guide elements of the guide slide.

8. The carriage as recited in claim 1 wherein the receiving plate includes multiple retaining elements engageable with the guide elements of the guide slide.

9. The carriage as recited in claim 1 further comprising at least one counterweight fastenable to the supporting frame.

10. The carriage as recited in claim 1 further comprising a first counterweight and a second counterweight, each fastenable to the supporting frame, the first counterweight being situated in the area of the first axle, and the second counterweight being situated in the area of the second axle.

11. The carriage as recited in claim 10 further comprising at least one first plug bolt and at least one second plug bolt on the supporting frame, the first counterweight being fastenable to the first plug bolt, and the second counterweight being fastenable to the second plug bolt.

12. The carriage as recited in claim 1 wherein two of the at least three wheels of the chassis are situated on a shared drive shaft of the first or second axle and are designed to be connectable to the gearwheel of the guide slide in the force- and torque-transmitting manner, one wheel of the two wheels being decoupleable from the drive shaft.

13. The carriage as recited in claim 5 wherein two of the at least three wheels of the chassis are situated on a shared drive shaft of the first or second axle and are designed to be connectable to the gearwheel of the guide slide in the force- and torque-transmitting manner, one wheel of the two wheels being decoupleable from the drive shaft; and wherein the wheel decoupleable from the drive shaft is decoupled from the drive shaft in the disengaged state of the coupling device.

* * * * *